US007320178B2

(12) United States Patent
Kirby et al.

(10) Patent No.: US 7,320,178 B2
(45) Date of Patent: Jan. 22, 2008

(54) STANDOFF FOR COLD PLATE AND COLD PLATE MADE WITH THE STANDOFF

(75) Inventors: Matthew J. Kirby, Bandera, TX (US); Jose L. Rodriguez, Fort Wayne, IN (US); Miguel Angel Herrera Bucio, Jose Lopez Portillo Reynosa Tamaulipas (MX)

(73) Assignee: IMI Cornelius Inc., Anoka, MN (US)

( * ) Notice: Subject to any disclaimer, the term of this patent is extended or adjusted under 35 U.S.C. 154(b) by 574 days.

(21) Appl. No.: 10/860,950

(22) Filed: Jun. 4, 2004

(65) Prior Publication Data

US 2004/0261266 A1 Dec. 30, 2004

Related U.S. Application Data

(60) Provisional application No. 60/480,513, filed on Jun. 20, 2003.

(51) Int. Cl.
*B23P 17/00* (2006.01)
*C21D 9/08* (2006.01)

(52) U.S. Cl. ..... 29/890.07; 29/890.03; 148/594; 148/604; 148/909; 165/172; 165/173; 174/15.1

(58) Field of Classification Search ..... 29/890.03, 29/890.07; 62/390; 165/80.4, 172, 173, 165/178; 361/701, 702; 174/15.1; 148/594, 148/604, 909, 600
See application file for complete search history.

(56) References Cited

U.S. PATENT DOCUMENTS 157,566 A * 12/1874 Bailey ..... 148/604
1,907,889 A * 5/1933 Stauffer ..... 24/483
1,943,591 A * 1/1934 Douglas ..... 439/723
2,189,281 A * 2/1940 Di Felice ..... 62/393
2,338,090 A * 1/1944 Bradfleld ..... 285/188
3,011,323 A * 12/1961 Jaeger ..... 62/396
3,484,919 A * 12/1969 Stier ..... 407/77
3,875,618 A * 4/1975 Schuplin ..... 24/16 PB
4,036,289 A * 7/1977 Cheng et al. ..... 165/82
4,252,578 A * 2/1981 Dumont et al. ..... 148/594
4,265,301 A * 5/1981 Anderson ..... 165/162
4,579,304 A * 4/1986 Williams ..... 248/68.1
4,586,831 A * 5/1986 Belanger ..... 384/297

(Continued)

*Primary Examiner*—Essama Omgba
(74) *Attorney, Agent, or Firm*—Pyle & Piontek, LLC

(57) ABSTRACT

A standoff for a cold plate and a cold plate using the standoff are characterized by a coil pack consisting of a plurality of individual fluid conveying tubes formed into a coil pack having a desired configuration and held in place by a plurality of retaining wires. The standoffs are slidably attached to the retaining wires and each comprises an elongate body that is triangular in cross-section, has a bottom end, an apex end opposite from the bottom end and a longitudinal bore toward the bottom end and through which a retaining wire extends. The standoffs are made of aluminum and are of sufficient size to maintain their structural integrity during a casting process in which the coil pack is placed in a mold and molten aluminum is poured around the coil pack. The standoffs support the coil pack above a lower surface of the mold and have a height between their base ends and apexes selected to create a desired thickness of cast aluminum material between the coil pack and an exterior surfaces of the finished cold plate.

19 Claims, 4 Drawing Sheets

U.S. PATENT DOCUMENTS 4,756,632 A * 7/1988 Belanger ..... 384/297
5,419,393 A * 5/1995 Guy, III ..... 165/168
5,507,340 A * 4/1996 Alston ..... 165/150
5,743,107 A * 4/1998 Kyees ..... 62/390
6,357,966 B1 * 3/2002 Thompson ..... 405/171
6,553,782 B1 * 4/2003 Kyees ..... 62/390
7,013,668 B2 * 3/2006 Kyees ..... 62/390

* cited by examiner

STANDOFF FOR COLD PLATE AND COLD PLATE MADE WITH THE STANDOFF

This application claims benefit of provisional application Ser. No. 60/480,513, filed Jun. 20, 2003.

FIELD OF THE INVENTION

The present invention relates generally to cold plates for cooling liquids, and in particular to a method of manufacturing such cold plates.

BACKGROUND OF THE INVENTION

Cast aluminum cold plates having a plurality of individual fluid conveying tubes joined into coil packs or tubing bundles that are encased in the cold plate and extend along serpentine paths are often used to provide heat exchange cooling of liquids flowed through the tubes. Such cold plates have particular application in the beverage dispense equipment industry for chilling beverage liquids such as concentrate beverage syrups and diluents for the syrups, which diluents typically consist of carbonated and non-carbonated or plain water that are mixed with the syrups at post-mix beverage dispensing valves t dispense cold drinks. In such an application, ice is placed on and in heat exchange contact with a top surface of a cold plate to provide for heat exchange cooling of beverage liquids as they flow through the serpentine coils of tubing encased in the cold plate. Cold plates are manufactured by pouring molten aluminum into a mold in which is first placed the fluid conveying tubes arranged in desired configurations. After cooling and hardening of the aluminum, the coil bundle is encased in the aluminum and the resulting cold plate is prepped and finished for placement into a beverage dispensing machine. In particular, the ice contacting and retaining surface of the cold plate is milled to produce a smooth finish on the surface in order to enhance heat exchange efficiency.

The molten aluminum poured into the cast is quite hot and to prevent warping and distortion of the coil pack or tubing bundle as it is heated during the casting process it is necessary that the coil pack, typically consisting of stainless steel tubing, be strapped together using metal wires that also are usually of stainless steel, in order that the coil pack be made to retain a desired configuration during the casting process. Without such restraint, movement of the coil pack as a result of the heat from the molten aluminum can warp and distort the coil pack to an undesired geometry, and excessive movement of the tubing can interfere with and prevent attaining a desired spacing of the tubing within the cold plate and from the outer surfaces of the cold plate. Such interference is of particular concern with respect to the top surface of the cold plate on which ice resides. If there is too little distance of the tubing from the top surface, tubing could show through the surface and be subject to mechanical damage relating to post casting surface finishing or from damage occurring when the cold plate is used in a beverage dispenser. If the is too great a distance between the tubing and the top surface, cooling performance will be negatively impacted.

To obtain optimum and consistent cooling performance it is therefore desired to control and maintain the position of the coil bundles within and from surfaces of the cast aluminum. To this end, portions of the wire restraints can be bent outward to comprise spacers or standoffs that extend from the coil bundle and contact the inner surfaces of the cold plate mold. The standoffs then define a desired spacing between the exterior surface of the cold plate and the coil bundle. A problem with this approach concerns the subsequent milling of the ice retaining cold plate top surface, since in cutting through the excess aluminum the milling equipment is also required to cut through the stainless steel standoffs, which dulls and wears out the cutting wheels of the milling equipment much more quickly than if they were to encounter only aluminum. As a result, the cost of the post casting finishing or milling process is greatly increased. Also, the stainless steel wire standoffs provided by the wire restraints have a lower coefficient of heat conduction than does aluminum, which detracts from the cooling performance of the cold plate.

Accordingly, it would be very desirable to have a tubing bundle standoff for use in the fabrication of cold plates that reduces or eliminate problems encountered with use of stainless steel wire standoffs.

OBJECTS OF THE INVENTION

An object of the present invention is to provide a standoff for a cold plate for ice/beverage dispensers and a method of manufacturing such a cold plate.

Another object of the present invention is to provide such a standoff for a cold plate which does not interfere with a subsequent milling operation of an upper ice contacting surface of the cold plate.

A further object of the present invention is to provide such a standoff that does not diminish the thermal conductivity of the cold plate.

SUMMARY OF THE INVENTION

In accordance with the present invention, a standoff for use with a retaining wire for wrapping around and retaining a coil pack in a desired configuration in the casting of a molten material around the coil pack for forming a cold plate, comprises an elongate body having a base end, an end opposite from the base end and a bore extending longitudinally through the body adjacent the base end. The bore is adapted to receive the retaining wire to accommodate positioning of the standoff along the retaining wire with the base end held by the retaining wire against the coil pack and the end opposite from the base end spaced from the coil pack by a height of the standoff.

In a preferred embodiment of the standoff, the body of the standoff has a triangular cross-section and the end opposite from the base end comprises an apex opposite from the base end. So as to have uniform thermal heat conductivity of the cold plate, the standoff is made of the same material as the molten material cast around the coil pack, which in the present case is aluminum. The casting of the molten material around the coil pack occurs in a mold with the apex of the standoff opposite from the base end resting on a bottom surface of the mold, so that the standoff supports the coil pack above the bottom surface of the mold by the height of the standoff. The bottom surface of the mold forms a top surface of the cold plate and the height of the standoff is selected so that the coil pack is spaced a selected distance from the bottom surface of the mold and therefore the selected distance from the top surface of the cold plate.

The invention also contemplates a cold plate made with the standoff. The cold plate is for chilling fluids and comprises a tubing bundle, at least one retaining wire wrapped around the tubing bundle, and at least one standoff having an elongate body with a base end, an end opposite from the base end and a bore extending longitudinally through the body adjacent the base end. The at least one retaining wire extends through the bore and holds the base of the at least one standoff against the tubing bundle with the end opposite from the base spaced from the tubing bundle by a height of the standoff. All of the tubing bundle, the at least one retaining wire and the at least one standoff are cast in metal to form the cold plate with the end of the standoff opposite from the base being at an upper surface of the cold plate.

In a preferred embodiment of the cold plate, the elongate body of the at least one standoff has a triangular cross-section and the end of the standoff opposite from the base end comprises an apex of the elongate body. So that the at least one standoff does not interfere with the thermal conductivity of the cold plate, it is made of the same material as the metal cast around the tubing bundle, the at least one retaining wire and the at least one standoff, which is contemplated to be aluminum. The arrangement is such that the end of the at least one standoff opposite from the base end is at a top surface of the cold plate.

The invention also contemplates a method of manufacturing a cold plate, which comprises the steps of forming a plurality of lengths of tubing into a tubing bundle having a desired configuration, and providing a standoff having an elongate body including a base end, an end opposite from the base end and a bore extending longitudinally through the body adjacent the base end. Also included are the steps of extending an end of a retaining wire through the bore of the standoff, such that the standoff can be slid and positioned along the retaining wire; retaining the tubing bundle in the desired configuration by wrapping the retaining wire around the tubing bundle and securing together opposite ends of the retaining wire with the base end of the standoff held against the tubing bundle, so that standoff extends outwardly from the tubing bundle to its end opposite from the base end to define a distance between the tubing bundle and an outer surface of the cold plate; placing the tubing bundle in a mold with the standoff supporting the tubing bundle the defined distance from a surface of the mold, and casting a molten cold plate material around the tubing bundle.

In a preferred practice of the method the standoff comprises a plurality of standoffs and the retaining wire comprises a plurality of retaining wires and the standoff and the cast material are of the same substance, which advantageously is aluminum. The step of placing the tubing bundle in the mold comprises placing the tubing bundle in the mold such that the end of the standoff opposite from the base end is set on a lower surface of the mold to support the tubing bundle above the lower surface by a distance equal to the height of the standoff between its base end and its end opposite from its base end. The lower surface of the mold forms an upper surface of the cast cold plate, and included is the step of milling the upper surface of the cast cold plate. The standoff is triangular in cross section and the end of the standoff opposite from the base end comprises an apex of the standoff.

DETAILED DESCRIPTION

Figure 1:
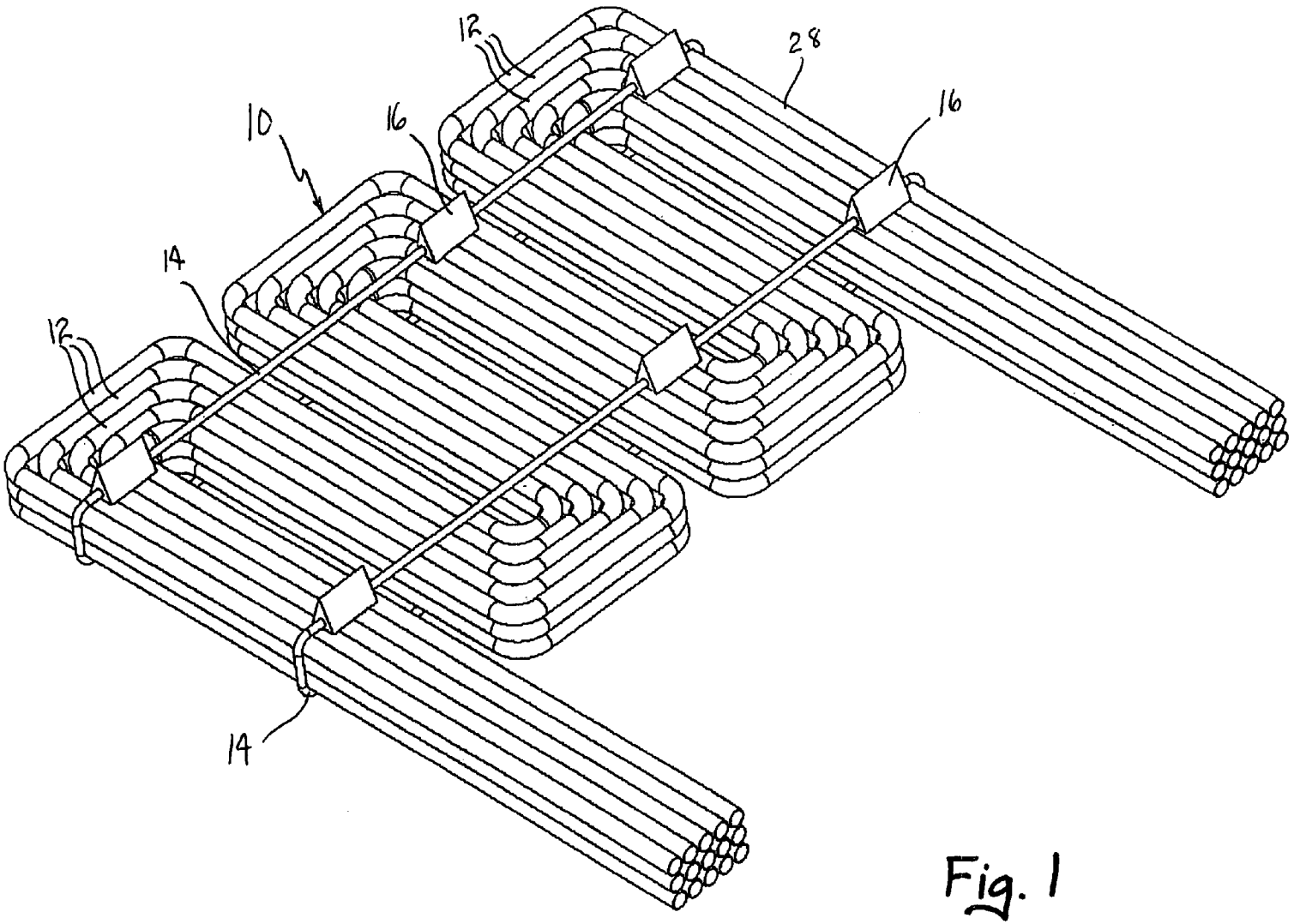
FIG. 1 is a perspective view of a standoff embodying the teachings of the present invention, being used with a coil pack for a cold plate prior to casting material around the coil pack to form the cold plate.
Figure 2:
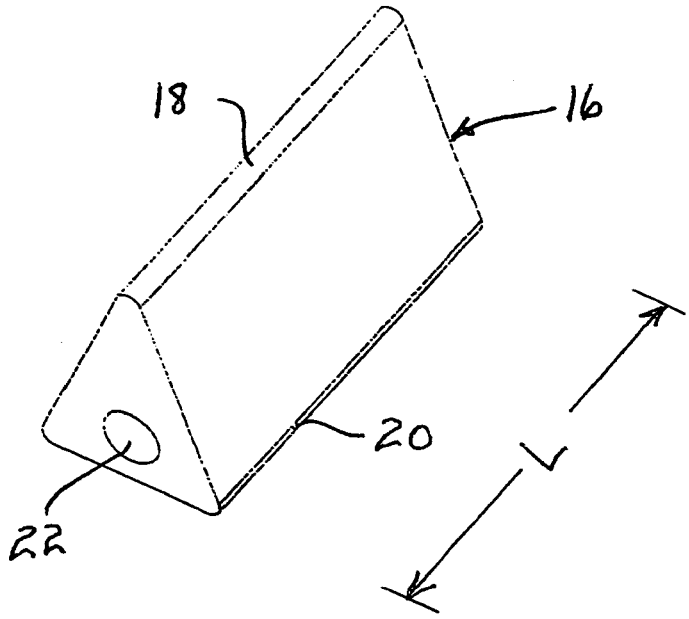
FIG. 2 is a perspective view of the standoff.
Figure 3:
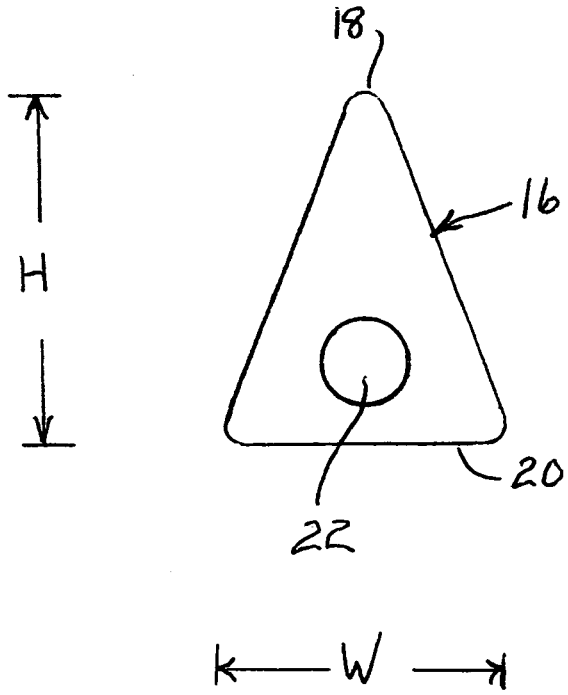
FIG. 3 is an end view of the standoff of FIG. 2.

Cold plates for ice/beverage dispensers are manufactured by pouring molten aluminum into a mold in which is positioned a coil pack comprising fluid conveying tubes arranged in desired configurations. A representative tubing bundle or coil pack for a cold plate is shown in FIG. 1 and indicated generally at 10. The coil pack 10 consists of a plurality of individual fluid conveying tubes 12 bent into a desired serpentine configuration and held together by retaining wires 14. According to the invention, triangular aluminum standoffs 16 are positioned along the wires 14 to provide for spacing between the coil pack 10 and a lower surface of a mold in which the coil pack is placed prior to pouring molten aluminum into the mold to cast and encase the coil pack in aluminum. As also seen in FIGS. 2 and 3, the standoffs 16 are elongate and have a pyramidal shape with a triangular cross-section, an apex 18 and a base end 20. An elongate bore 22 extends longitudinally through a lower end of each standoff 16 toward or near the base end 20. As is known, the retaining wires 14 are cut to length and the free ends of the wires are secured together as by twisting, clamping and/or welding to hold the individual tubes comprising the coil pack 10 in place. Prior to securing the ends of the retaining wires 14, the standoffs 16 are positioned on the wires by extending ends of the wires 14 through the bores 22 of the standoffs. One or more standoffs 16 are threaded onto each retaining wire 14 and the positions of the standoffs along the wire are adjusted as desired. The base ends 20 of the standoffs 16 are held by the wires 14 against the fluid tubes 12 and the length of each standoff advantageously permits its base end to span across and contact two or more individual fluid tubes. In a typical application, the standoffs 16 can have an apex to base height H on the order of about 0.56 inch, a base width W on the order of about 0.44 inch and a length L on the order of about 1.0 inch.

In the manufacture of a cold plate using the tubing bundle or coil pack 10, the coil pack is formed into a desired serpentine configuration and properly retained in the desired configuration by one or more retaining wires 14 wrapped around the coil pack with the standoffs 16 positioned along the retaining wires as desired. The entire coil pack assembly 10, as depicted in FIG. 1, is then placed upside down in a suitably configured conventional mold with the apexes 18 of the standoffs 16 against a bottom surface of the mold. The standoffs 16 then support the coil pack in and in proper spaced relationship above the bottom surface of the mold, with the spacing being determined by the height H of the standoffs. The coil pack 10 is then cast in aluminum by pouring molten aluminum into the mold and over and around the coil pack, so that the coil pack ends up being encased in aluminum.

Figure 4:
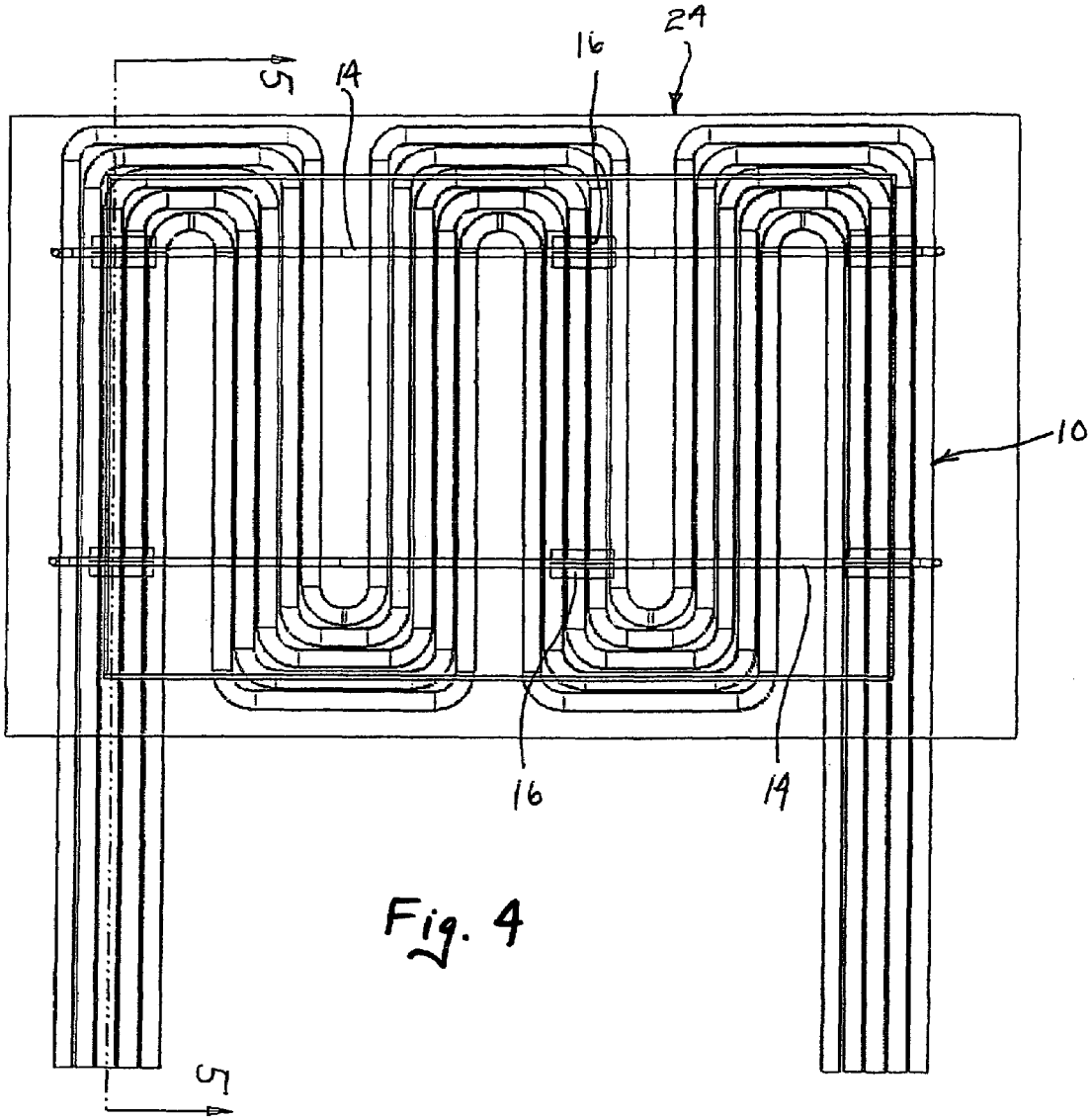
FIG. 4 is a top plan view of a cold plate manufactured using the standoff.
Figure 5:
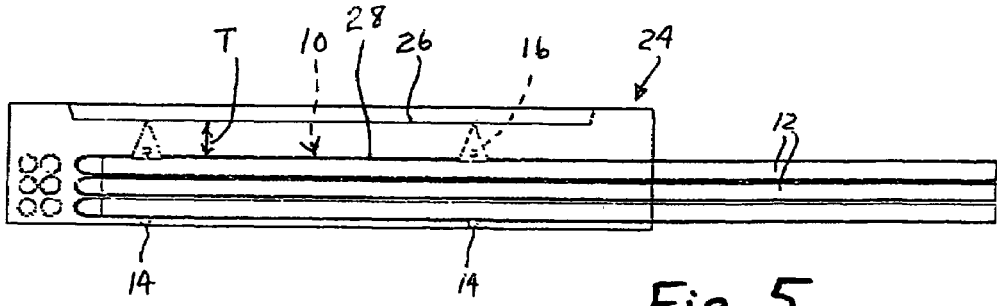
FIG. 5 is a cross-sectional side elevation view taken along lines 5-5 of FIG. 4.

After the casting operation the resulting cold plate, as seen in FIGS. 4 and 5 and indicated generally at 24, is removed from the mold for milling of its top ice retaining surface 26 to smooth the surface in order to enhance the heat transfer efficiency of the cold plate. Because the coil pack 10 is placed in the mold upside down and supported on the apexes of the standoffs 16, the bottom surface of the mold defines the upper ice contacting surface of the resulting cold plate 24, and it is seen that the standoffs 16 provide for a desired thickness T of aluminum between the top ice retaining surface 26 of the cold plate and a top surface 28 of the coil pack. This thickness T corresponds to and is determined by the height H of the standoffs 16. The top surface 26 of the cold plate 24 can then be milled a desired amount to reduce the initial cast top surface thickness T as desired and to smooth the top surface to enhance its heat transfer ability.

It is understood that that while the standoffs 16 are shown as being of pyramidal configuration and triangular in cross-section, they could just as readily be of a wide variety of other geometric shapes. It is important, however, that the aluminum standoffs 16 be sufficiently robust and have sufficient mass that they not only are not quickly melted by the molten aluminum that flows around them in the casting process, but also so that they maintain sufficient structural integrity to maintain the position of the coil pack 10 within the mold until the molten aluminum cools. A further advantage of the standoffs 16 is that being made of aluminum they are less destructive to the internal surfaces of the cold plate mold than would be stainless steel standoffs, and by virtue of the apexes 18 being elongate, the standoffs contact the mold inner surface along a line, rather than at a point as do prior art wire standoffs. As a result, there is less pressure against the mold bottom surface which lessens the likelihood of any destructive contact with and damage to the surface.

Figure 6:
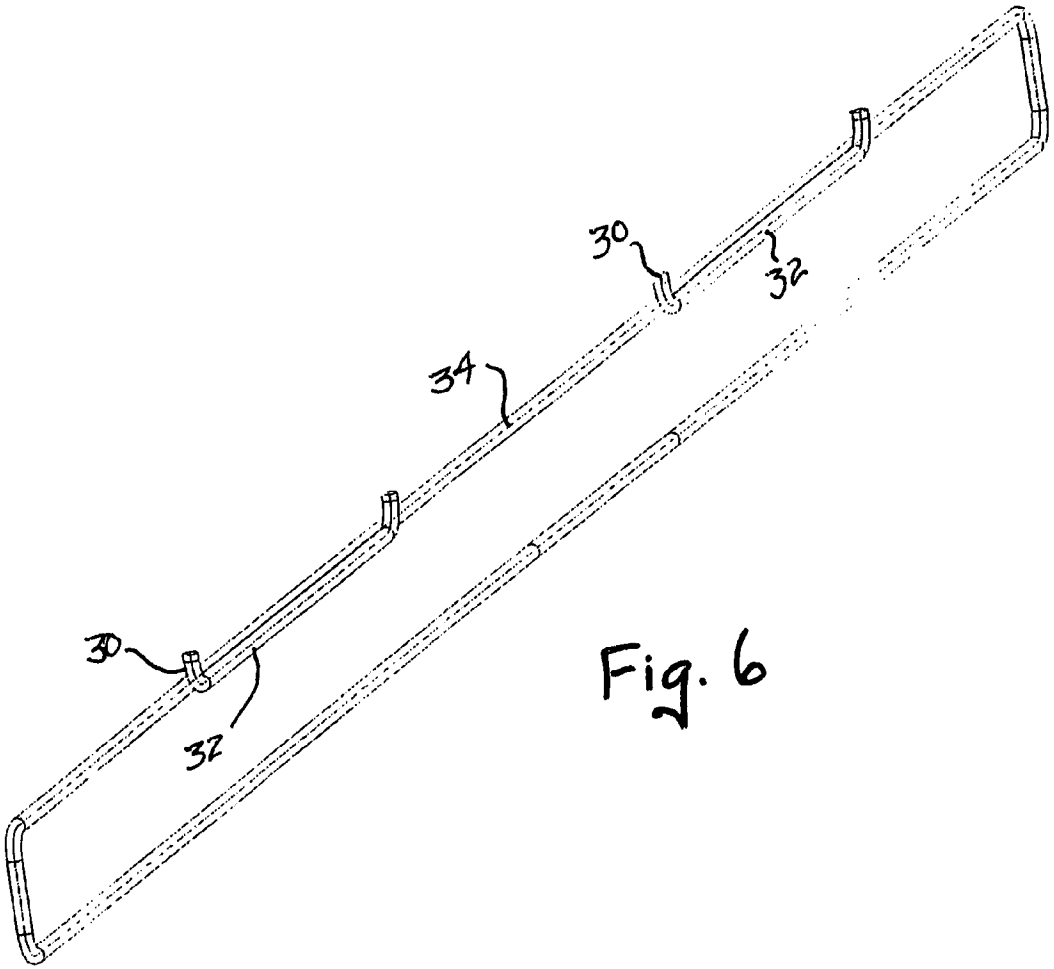
Fig. 6 Prior Art
FIG. 6 shows a prior art standoff.

It is to be appreciated that the much larger footprints of the base ends 20 of the standoffs 16 enable the standoffs to easily span across two or more of the individual fluid conveying tubes of the coil pack 10 and to come in contact with the "highest" points on the surfaces thereof. The standoffs 16 therefore maintain a desired minimum standoff distance and they are not easily deflected by contact with the inner bottom surface of a mold when closed within the mold. In contrast, as seen in FIG. 6 a prior art standoff 30 consists of an upturned end of a length of wire 32 secured to a retaining wire 34. Such a conventional standoff structure 30 is difficult to position with any precision relative to a coil pack with which it is used. Such conventional standoffs 30 can easily end up positioned between two coils, with the result that the standoff distance from the top surface of a cold plate is not as firmly and accurately maintained as there can be an undesired "give" in such a standoff 30 as it contacts the mold inner surface and is deflected inward between two coils, causing a diminution of the desired spacing distance between the coil pack and the top surface of the cold plate.

While an embodiment of the invention have been described in detail, various modifications and other embodiments thereof can be devised by one skilled in the art without departing from the spirit and scope of the invention, as defined in the appended claims.

What is claimed is:

1. A coil pack assembly for use in fabricating a cold plate, said coil pack assembly comprising: a coil pack formed in a desired configuration; a retaining wire that is wrapped around and retains said coil pack in a desired configuration in a subsequent casting of a molten material around said coil pack to form a cold plate and a standoff comprising an elongate body having a base end, an end opposite from said base end and a bore extending longitudinally through said body near said base end, said bore receiving said retaining wire therethrough to accommodate positioning said standoff along said retaining wire with said base end held by said retaining wire against said coil pack and said end opposite from said base end spaced from said coil pack by a height of said standoff.

2. A coil pack assembly as in claim 1, wherein said standoff body has a triangular cross-section and said end opposite from said base end comprises an apex of said body.

3. A coil pack assembly as in claim 1, wherein said standoff is made of the same material as a molten material cast to be subsequently cast around said coil pack.

4. A coil pack assembly as in claim 1, wherein said standoff and the molten material cast subsequently around the coil pack are aluminum.

5. A coil pack assembly as in claim 1, wherein subsequently casting the molten material around said coil pack occurs in a mold with said end of said standoff opposite from said base end resting on a bottom surface of the mold, so that said standoff supports said coil pack above the bottom surface of the mold by said height of said standoff.

6. A coil pack assembly as in claim 5, wherein the bottom surface of the mold forms a top surface of the cold plate and said height of said standoff is selected so that said coil pack assembly is spaced a selected distance from the bottom surface of the mold and thereby from the top surface of the cold plate.

7. A cold plate for chilling fluids, said cold plate comprising a tubing bundle, at least one retaining wire wrapped around said tubing bundle, at least one standoff having an elongate body with a base end, an end opposite from said base end and a bore extending longitudinally through said body near said base end, said at least one retaining wire extending through said bore for holding said at least one standoff with said base end against said tubing bundle and said end opposite from said base end spaced from said tubing bundle by a height of said standoff, all of said tubing bundle, said at least one retaining wire and said at least one standoff being cast in metal to form said cold plate with said end of said standoff opposite from said base end being at an upper surface of said cold plate.

8. A cold plate as in claim 7, said elongate body of said at least one standoff having a triangular cross-section and said end of said standoff opposite from said base end comprising an apex of said elongate body.

9. A cold plate as in claim 7, wherein said at least one standoff is made of the same material as said metal cast around said tubing bundle, said at least one retaining wire and said at least one standoff.

10. A cold plate as in claim 7, wherein said at least one standoff and said metal cast around said tubing bundle, said at least one retaining wire and said at least one standoff are aluminum.

11. A cold plate as in claim 7, wherein said end of said at least one standoff opposite from said base end is at a top surface of said cold plate.

12. A method of manufacturing a cold plate, comprising the steps of forming a plurality of lengths of tubing into a tubing bundle having a desired configuration; providing a standoff having an elongate body including a base end, an end opposite from the base end and a bore extending longitudinally through the body near the base end; extending one end of a retaining wire through the standoff bore, such that the standoff can be slid and positioned along the retaining wire; retaining the tubing bundle in the desired configuration by wrapping the retaining wire around the tubing bundle and securing together opposite ends of the retaining wire with the base end of the standoff held against the tubing bundle, so that standoff extends outwardly from the tubing bundle to its end opposite from the base end; placing the tubing bundle in a mold with the standoff supporting the tubing bundle a distance from a surface of the mold as determined by the height of the standoff between its base end and its end opposite from its base end; and casting a molten cold plate material around the tubing bundle, retaining wire and standoff.

13. A method as in claim 12, wherein the standoff comprises a plurality of standoffs and the retaining wire comprises a plurality of retaining wires.

14. A method as in claim 12, wherein the standoff and the cast material are of the same substance.

15. A method as in claim 12, wherein the standoff and the cast material are aluminum.

16. A method as in claim 12, wherein said step of placing the tubing bundle in the mold comprises placing the tubing bundle so that the end of the standoff opposite from the base end is set on a lower surface of the mold to support the tubing bundle above the lower surface of the mold by a distance equal to the height of the standoff between its base end and its end opposite from its base end.

17. A method as in claim 16, wherein the lower surface of the mold forms an upper surface of the cast cold plate.

18. A method as in claim 17, including the step of milling the upper surface of the cast cold plate.

19. A method as in claim 12, wherein the standoff is triangular in cross section and the end of the standoff opposite from the base end comprises an apex of the standoff.

* * * * *